US011078740B2

(12) United States Patent
Bonavides et al.

(10) Patent No.: US 11,078,740 B2
(45) Date of Patent: Aug. 3, 2021

(54) WELLBORE RADIAL POSITIONING APPARATUS

(71) Applicant: Saudi Arabian Oil Company, Dhahran (SA)

(72) Inventors: Clovis Satyro Bonavides, Dhahran (SA); Vladislav Torlov, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 1 day.

(21) Appl. No.: 16/270,392

(22) Filed: Feb. 7, 2019

(65) Prior Publication Data

US 2020/0256145 A1 Aug. 13, 2020

(51) Int. Cl.

| | |
|---|---|
| ***E21B 23/14*** | (2006.01) |
| *E21B 49/02* | (2006.01) |
| *E21B 49/10* | (2006.01) |

(52) U.S. Cl.

CPC ..... *E21B 23/14* (2013.01); *E21B 49/02* (2013.01); *E21B 49/10* (2013.01)

(58) Field of Classification Search

CPC ..... E21B 23/14; E21B 49/10; E21B 49/02; E21B 17/05

See application file for complete search history.

(56) References Cited

U.S. PATENT DOCUMENTS

| | | | | |
|---|---|---|---|---|
| 2,994,770 | A | 8/1961 | Indurthivenka Ta et al. | |
| 4,192,380 | A * | 3/1980 | Smith | E21B 17/1021 166/104 |
| 5,541,587 | A | 7/1996 | Priest | |
| 5,629,480 | A * | 5/1997 | Herget | E21B 47/01 166/66 |
| 6,173,773 | B1 | 1/2001 | Almaguer et al. | |
| 6,655,458 | B2 | 12/2003 | Kurkjian et al. | |
| 7,343,977 | B2 | 3/2008 | Martin et al. | |
| 7,886,842 | B2 | 2/2011 | Howard et al. | |
| 7,933,166 | B2 | 4/2011 | Goodman | |
| 9,182,517 | B1 | 11/2015 | Selman et al. | |
| 9,689,256 | B2 | 6/2017 | Tevis et al. | |
| 10,920,511 | B2 | 2/2021 | Bonavides et al. | |
| 2005/0139357 | A1 | 6/2005 | Martin et al. | |
| 2009/0025941 | A1 | 1/2009 | Iskander | |

(Continued)

FOREIGN PATENT DOCUMENTS

| | | |
|---|---|---|
| GB | 2300441 | 11/1996 |
| WO | 2009014932 | 1/2009 |

OTHER PUBLICATIONS

Schlumberger, "WPP: Wireline perforating platform," slb.com/perforating, Schlumberger, 14-PE-0011, 2014, 2 pages.

(Continued)

*Primary Examiner* — Taras P Bemko
*Assistant Examiner* — Yanick A Akaragwe
(74) *Attorney, Agent, or Firm* — Fish & Richardson P.C.

(57) ABSTRACT

A wellbore radial positioning apparatus includes a tool body and a motor that actuates a traction wheel. The tool body is configured to be positioned within a wellbore. The motor driving the traction wheel is connected to the tool body and is configured to rotate the tool body in the wellbore. The traction tool is configured to frictionally contact or attach to the wellbore. The tool body is rotated in the wellbore by the action of the motor actuating the traction wheel.

20 Claims, 7 Drawing Sheets

(56) References Cited

U.S. PATENT DOCUMENTS

| | | | | |
|---|---|---|---|---|
| 2011/0107830 | A1* | 5/2011 | Fields | E21B 49/06 73/152.41 |
| 2013/0081803 | A1* | 4/2013 | Tao | E21B 17/1014 166/247 |
| 2014/0174759 | A1 | 6/2014 | Harrigan | |
| 2017/0167235 | A1 | 6/2017 | Jong et al. | |
| 2018/0003032 | A1 | 1/2018 | Donzier et al. | |
| 2019/0316432 | A1* | 10/2019 | Michaud | E21B 23/00 |

OTHER PUBLICATIONS

International Search Report and Written Opinion issued in International Application No. PCT/US2019/067805 dated Apr. 21, 2020, 12 pages.

International Search Report and Written Opinion issued in International Application No. PCT/US2020/016508 dated May 28, 2020, 13 pages.

* cited by examiner

WELLBORE RADIAL POSITIONING APPARATUS

TECHNICAL FIELD

This disclosure relates to downhole tool positioning devices for oil and gas applications.

BACKGROUND

Properties of a rock formation may be tested using various downhole logging tools by deploying such tools to desired depths within the rock formation and then operating the tools to produce measurements. Accurately controlling or changing an angular position of a logging tool can be a necessary task. A tool orientation change may be required because of operational needs, such as irregular borehole shape at certain angular positions, or because of necessity to obtain a sample at a preferred orientation, for instance due to radially anisotropic properties of the rocks (such as permeability, elastic parameters etc.). Attempts to test a rock formation are often unsuccessful due to radially irregular borehole shape at the desired tests intervals and no radial position control of a logging tool within a wellbore, which can result in an inaccurate or otherwise unfavorable position of the logging tool, and consequently failed survey or sample acquisition.

SUMMARY

This specification describes technologies relating to a wellbore radial positioning apparatus.

Certain aspects of the subject matter described here can be implemented as a well tool system. The system includes a tool body, a motor and a traction (friction) tool. The tool body is configured to be positioned within a wellbore. The motor is connected to the tool body and is configured to rotate the tool body within the wellbore. The traction tool is connected to the tool body and is configured to attach to the wellbore. The tool body is configured to rotate relative to the traction tool when the traction tool is in a firm contact with the wellbore.

An aspect combinable with any of the other aspects can include one or more of the following features. The traction tool includes a friction sprocket configured to be frictionally attached to the wellbore.

An aspect combinable with any of the other aspects can include one or more of the following features. The system includes a decentralizing tool connected to the tool body. The decentralizing tool is configured to cause the tool body to be eccentric relative to a longitudinal axis of the wellbore.

An aspect combinable with any of the other aspects can include one or more of the following features. The decentralizing tool is configured to swivel relative to the tool body.

An aspect combinable with any of the other aspects can include one or more of the following features. The system includes a first sleeve connected to a first end of the decentralizing tool and a second sleeve connected to a second end of the decentralizing tool. Each sleeve is connected to the tool body and is configured to rotate relative to the tool body.

An aspect combinable with any of the other aspects can include one or more of the following features. The decentralizing tool includes a decentralizing spring.

An aspect combinable with any of the other aspects can include one or more of the following features. The decentralizing spring is configured to expand to cause the traction tool to be in a firm contact with the wellbore.

An aspect combinable with any of the other aspects can include one or more of the following features. The system includes a position sensor connected to the tool body. The positioning sensor is configured to determine a radial position of the tool body in the wellbore.

An aspect combinable with any of the other aspects can include one or more of the following features. The motor is configured to rotate the tool body based on the angular position of the tool body determined by the positioning sensor.

An aspect combinable with any of the other aspects can include one or more of the following features. The positioning sensor includes at least one radial positioning sensor.

An aspect combinable with any of the other aspects can include one or more of the following features. The system includes a swivel configured to couple to a wireline (drill pipes, coil tubing or other conveyance system) to lower the well tool system into a wellbore. The tool body is configured to rotate relative to the swivel.

An aspect combinable with any of the other aspects can include one or more of the following features. The system includes a test probe connected to the tool body. The test probe is configured to perform a well test within the wellbore to determine a wellbore property or to obtain a sample.

An aspect combinable with any of the other aspects can include one or more of the following features. The motor is connected to a downhole end of the tool body. The traction tool is connected to a downhole end of the motor.

Certain aspects of the subject matter described here can be implemented as a well tool system. The system includes a tool body, traction (friction) tool, a positioning sensor and a motor. The tool body is configured to be positioned within a wellbore and to rotate within the wellbore. The traction tool is connected to the tool body. The traction tool is configured to attach to the wellbore when the test probe part of the tool is being rotated. The positioning sensor is configured to determine the angular position of the tool body within the wellbore. The motor is axially connected to the tool body and is actuated from surface when the adjustment of the angular position is required based on the position sensor data.

An aspect combinable with any of the other aspects can include one or more of the following features. The motor is configured to cease rotation of the tool body within the wellbore in response to the angular position matching a pre-determined angular position of the tool body.

An aspect combinable with any of the other aspects can include one or more of the following features. The system includes a decentralizing tool connected to the tool body. The decentralizing tool is configured to maintain the tool body eccentric relative to a longitudinal axis of the wellbore.

An aspect combinable with any of the other aspects can include one or more of the following features. The decentralizing tool is configured to swivel relative to the tool body.

An aspect combinable with any of the other aspects can include one or more of the following features. The system includes a first sleeve connected to a first end of the decentralizing tool and a second sleeve connected to a second end of the decentralizing tool. Each sleeve is connected to the tool body and configured to rotate relative to the tool body.

An aspect combinable with any of the other aspects can include one or more of the following features. The decentralizing tool includes a decentralizing spring.

An aspect combinable with any of the other aspects can include one or more of the following features. The decentralizing tool includes a pad tool attached to the tool body on one end and configured to contact the inner wall of the wellbore at another end.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes a wellbore apparatus for precisely changing a radial position of a tool attached thereto within a wellbore of a formation. The wellbore apparatus is configured to decenter a tool to an inner wall of a wellbore in which the system is positioned, for example, in an uncased portion of the wellbore. The wellbore tool system is also configured to rotate the tool within the wellbore to precisely adjust its angular position. The apparatus is configured with a rotating sprocket or any other type of traction (friction) wheel, which provides the ability to rotate the tool by exerting a force against a borehole. Because the sprocket is rotated by an electric or hydraulic motor that has its body (stator) rigidly attached to the tool body, the tool body is forced to rotate. The motor actuation can be stopped when the radial position feedback sensors detect a favorable tool orientation.

The wellbore tool system includes a motor that can rotate the tool within the wellbore around a longitudinal axis of the wellbore tool. The well tool system includes rotational (or radial) position sensors, for example, accelerometers, magnetometers, shaft mounted angle encoders, gyroscopes, or similar angular position sensors to provide feedback on angular position of the well tool. In the context of this disclosure, "angular position" means a position of the well tool system as it rotates about its longitudinal axis or about the wireline from which it is suspended. Incremental rotation of the well tool system result in a change in the angular position of the well tool system within the wellbore. The motor can rotate the well tool based either on absolute tool position or relative to the initial tool position before the stationary survey (sampling or coring) is performed.

Figure 1:
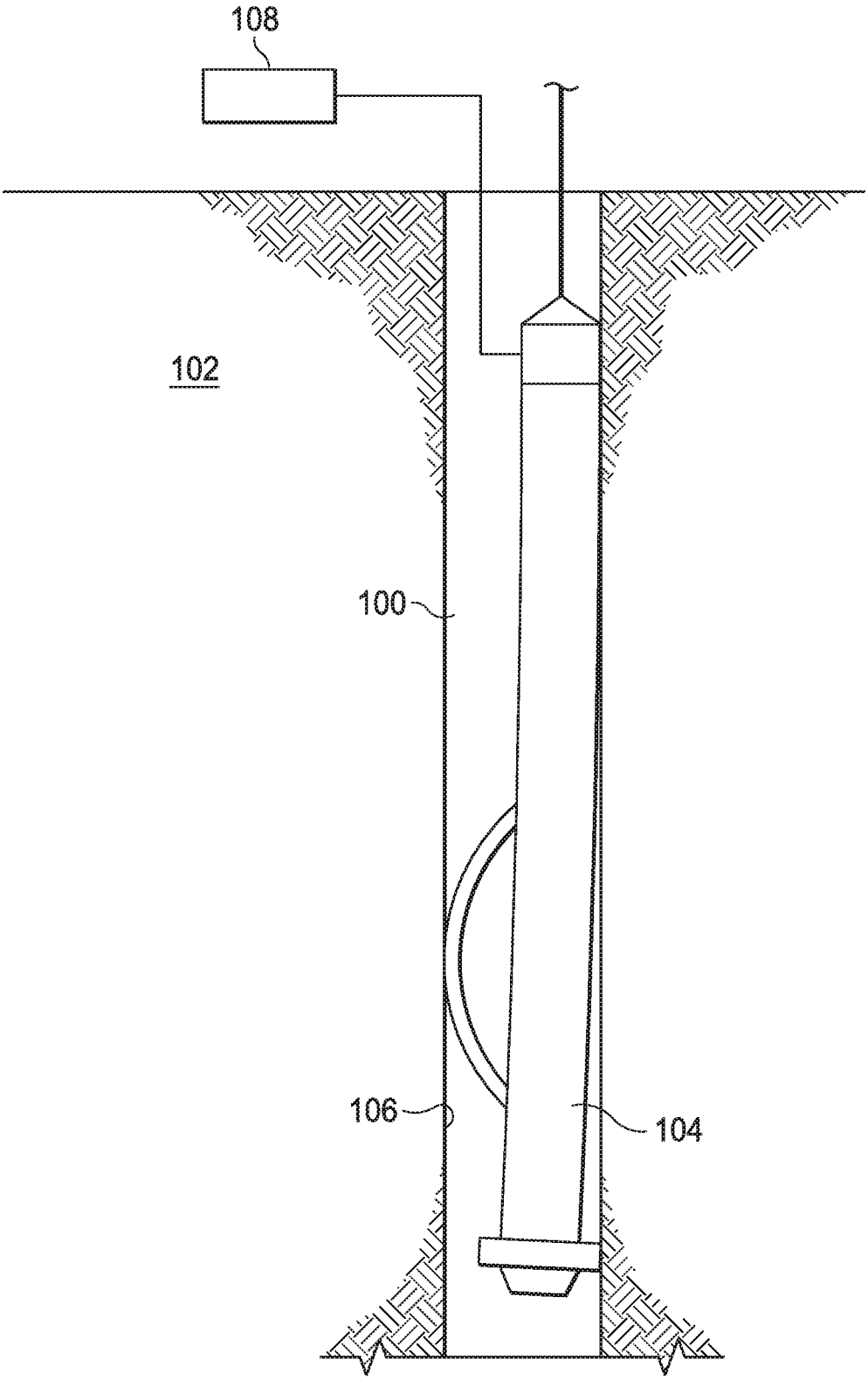
FIG. 1 is a schematic diagram of a well tool system deployed in an open wellbore.

FIG. 1 is a schematic diagram of a well tool system 104 deployed in an open wellbore 100. While the schematic diagram shows the well tool system 104 as being rigid, in some implementations, the well tool system 104 can include flex joints that reduce a rigidity of the well tool system and permit a level of tilting in the body of the system 104. The wellbore 100 is open, that is, uncased. The wellbore tool system 104 carries a well tool (described later), which is to be deployed in the open wellbore 100. That is, the well tool system 104 is lowered into the wellbore 100, for example, via a wireline, slickline, coiled tubing, drill pipes or similar conveyance system, and the well tool is positioned in the wellbore 100 to perform certain well operations. Example of the well tools that may be coupled to the well tool system 104 within the wellbore 100 include measurement tools (for example, a formation tester, such as a probe with a packer), a stationary survey tool, a coring bit, or any other type of actuating device. One or more additional tools (for example, telemetry module, gamma ray, and caliper tools) may be attached to the well tool along other portions of the tool body within the wellbore 100.

The well tool system 104 is connected to a controller 108 positioned at a surface of the wellbore 102. The controller 108 can exchange signals with the well tool system 104. The signals can include instructions to the well tool system 104 to perform operations or information indicative of an operation of the well tool system 104 or of well conditions, or a combination of them. The controller 108 can be implemented as a computer system including a processor (for example, a single processor or a distributed array of two or more processors) and a computer-readable medium storing instructions executable by the processor to perform operations. The controller 108 can, alternatively or in addition, be implemented as processing circuitry, software, firmware, hardware or a combination of them.

As described later, the well tool system 104 is configured to contact an inner wall 106 of the wellbore 100 by the eccentralizing spring, or a controllable radially extendable pad. In cases of deviated wellbores, the tool system 104 is decentered by the gravity force. Subsequently, the well tool system 104 is configured to rotate to a particular angular position within the wellbore 100 while being attached to the borehole wall 106. Upon rotationally orienting itself to the particular angular position, the well tool system 104 remains stationary while well operations are performed. By changing the conveyance system depth, the well tool system 104 can be shifted to a different depth in the wellbore 100, or be raised to the surface.

Figure 2A:
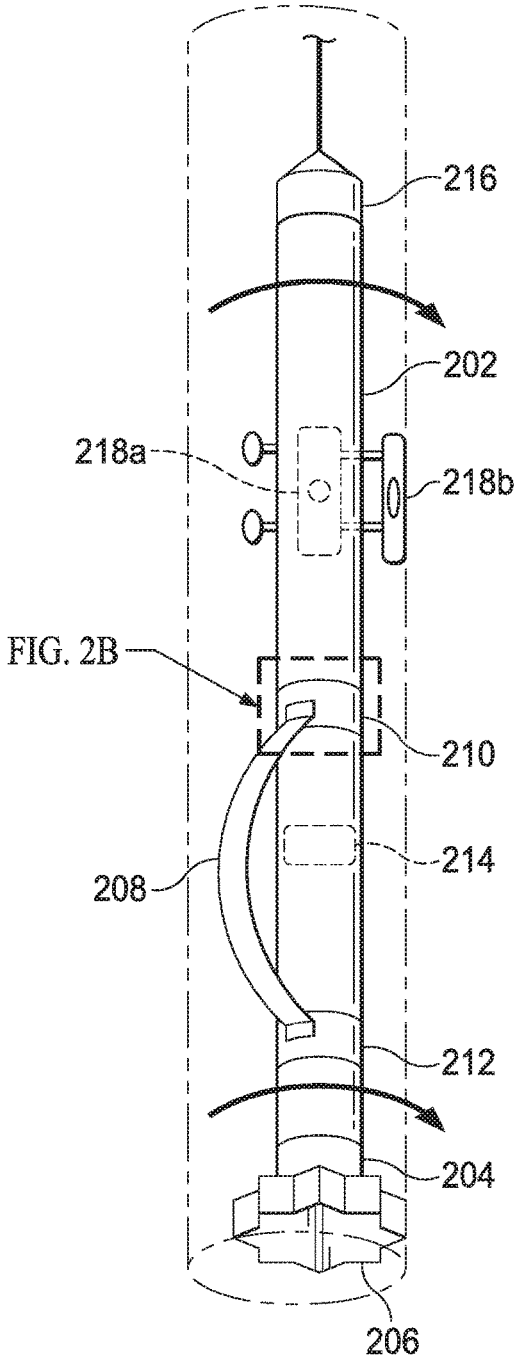
FIG. 2A is a schematic diagram of the well tool system of FIG. 1.

FIG. 2A is a schematic diagram of the well tool system 104 positioned within the wellbore 100. The well tool system 104 includes a tool body 202 configured to be positioned within the wellbore 100. The tool body 202 can include an elongated tube (hollow or solid) that can be coupled on both ends to other equipment, for example, threadedly or otherwise. A motor 204 that can turn a sprocket or a friction wheel 206 is connected to the tool body 202. In the well tool system 104 shown schematically in FIG. 1, the motor 204 is axially connected nearer a downhole end of the tool body 202 than an uphole end of the tool body 202. Other devices may be attached to the bottom of the sprocket wheel, rotating with it, such as a bull nose or a hole finder for improved conveyance. While being eccentered and in a first contact with the borehole wall, the motor 204 is configured to rotate the sprocket wheel 206, making the tool body also rotate within the wellbore 100 by the reaction force that is generated when the sprocket 206 is in contact with the wellbore wall. The part that needs rotation is the tool body to which a survey probe or actuation mechanism is attached. Therefore, in order to avoid rotating other parts of the system, such as a wireline cable or a Gamma Ray tool that do not need to be rotated and may exert a considerable force against the rotation action, the well tool system 104 can include a swivel 216 that is coupled, on one end, to other downhole instrumentation and the conveyance system. The tool body 202 is coupled to the other end of the swivel 216. As the tool body 202 rotates in response to a rotational force from the motor 204 and the sprocket wheel 206 when it contacts the borehole wall, the swivel 216 prevents the rotational motion from being transferred to other system components.

The well tool system 104 includes a sprocket wheel or a rotating sprocket 206 connected to the tool body 202. The sprocket 206 is designed to transmit rotational force to the tool through its friction against the wellbore wall 106. If the sprocket "bytes" firmly, i.e. locks onto the wellbore wall such that it no longer can be turned relative to the well, the reaction force to the rotational force exerted by the motor will act on the tool body and make it rotate relative to the well. That is, the traction tool 206 is configured to contact the inner wall 106 of the wellbore 100 and, by friction or other form of traction, either remain spatially fixed relative to the wellbore 100 or at least provide an amount of rotation (angular position change) of the tool relative to the wellbore. The motor 204 rotates the sprocket 206 and its stator is rigidly attached to the tool body. In some implementations, the traction tool 206 is a friction wheel or a sprocket wheel with jagged edges that frictionally contacts the inner wall of the wellbore 106. The sprocket slips while the tool body 202 rotates. An outer diameter of the friction wheel or the sprocket wheel may be configurable at surface and is selected to be greater than an effective outer diameter of the tool body 202 and the widest component attached to the tool body 202. That is, the effective diameter of the friction wheel or the sprocket wheel is greater than the effective diameter at any other parts of the tool body 202. Having the largest effective diameter of the well tool system 104 allows the sprocket 206 to firmly contact the inner wall, providing traction to the turning mechanism. In some implementations, the friction wheel 206 can be expandable at the downhole location, for example, by an actuating mechanism that can include a motor and linkages, to attach to the inner wall 106.

The friction wheel 206 is directly connected to the motor 204. If the motor 204 cannot rotate the friction wheel 206 (sprocket) it will still rotate the tool body 202 to which it is rigidly attached. The motor turning the traction wheel is connected to the surface controller 108 via telemetry link.

The well tool system 104 includes a decentralizing tool or a spring 208 connected to the tool body 202. The decentralizing spring 208 is configured to cause the tool body 202 to be in firm contact with the wellbore wall 106 relative to a longitudinal axis of the wellbore 100. The decentralizing tool 208 is configured to freely swivel around an outer circumference of, the tool body 202. This assures a fixed position of 208 while the tool 202 is being rotated to desired position by the motor 204. The decentralizing tool 208 is configured to cause the tool body 202 to be decentered relative to the longitudinal axis of the wellbore 100.

Figure 2B:
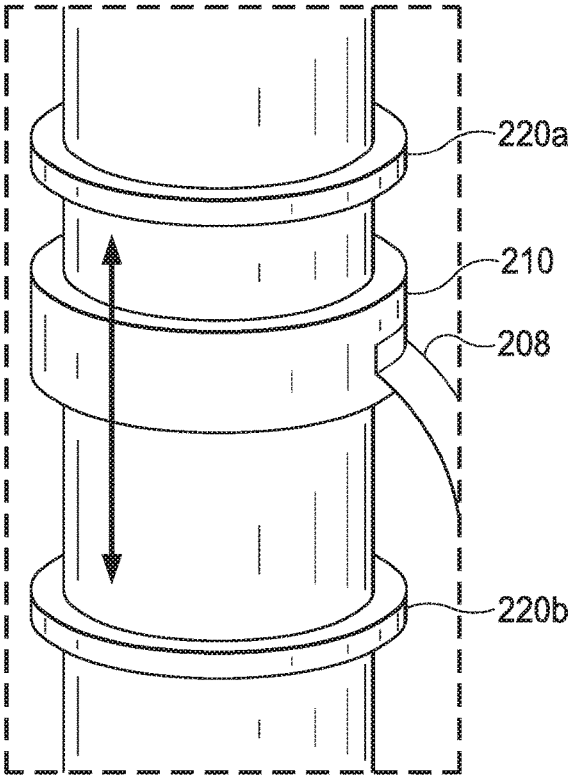
FIG. 2B is a schematic diagram of locking rings connected to the well tool system.

In some implementations, the decentralizing tool 208 is a decentralizing spring that is configured to flex, that is, expand and contract. For example, the well tool system 104 includes a first sleeve 210 connected to a first end of the decentralizing tool 208. The first sleeve 210 is installed over the outer surface of tool housing. The first sleeve 210 is configured to rotate relative to the tool body 202. FIG. 2B is a schematic diagram of locking rings 220*a*, 220*b* connected to the well tool system. In some implementations, each lock ring is a circular disc that surrounds the tool body 202. The locking rings 220*a* and 220*b* are installed on the outer sides of the first sleeve 210, thereby limiting the axial movement of the first sleeve 210 and the decentralizing tool 208 attached to the first sleeve 210. The axial position of each ring on the tool body 202 can be modified to vary the distance between the two rings, thereby defining an axial distance by which the first sleeve 210 can be moved. Using locking members, for example, screws, each ring can be locked to or unlocked from the outer surface of the tool body 202.

The well tool system 104 includes a second sleeve 212 connected to a second end of the decentralizing tool 208. The second sleeve 212 is connected to, for example, surrounds an outer circumference of, the tool body 202. The second sleeve 212 is configured to rotate relative to the tool body 202. Both sleeves can move axially for a certain distance relative to the tool body 202, determined by the position of lock rings (not shown) similar to those shown in and described with reference to FIG. 2B. The lock rings assure that the eccentralization spring can move along the tool axis while the tool 104 is being transported along the borehole 100.

The well tool system 104 includes a radial positioning sensor 214 connected to the tool body 202. The positioning sensor 214 is configured to determine a angular position of the tool body 202 in the wellbore 100 relative to a given reference, such as the high side of the borehole in deviated wellbores or the Geographic North. It may also provide a measurement of angular change relative to the last position of the probe when the tool was stationary, informing the amount of rotation (degrees or radians) the probe accumulated since actuation of the rotating motor started. In many instances all the operator may want is to rotate the tool body by a certain amount, like ¼ of a turn, relative to its last set position. This action may also be implemented by trial and error, with the operator trying to change the radial position of the tool by actuating the motor turning the sprocket (traction/friction wheel), stopping it and checking through the feedback system, if the current radial position is a favorable one. For example, the positioning sensor 214 can be one or more accelerometers, magnetometers, gyroscopes, turn rate meters, shaft mounted angle encoders, similar angular position sensors or any combination of them. The positioning sensor 214 and associated circuitry transmits position signals to the controller 108, thus allowing operator to adjust the radial position of the test device (probe, coring bit etc.).

Figure 2C:
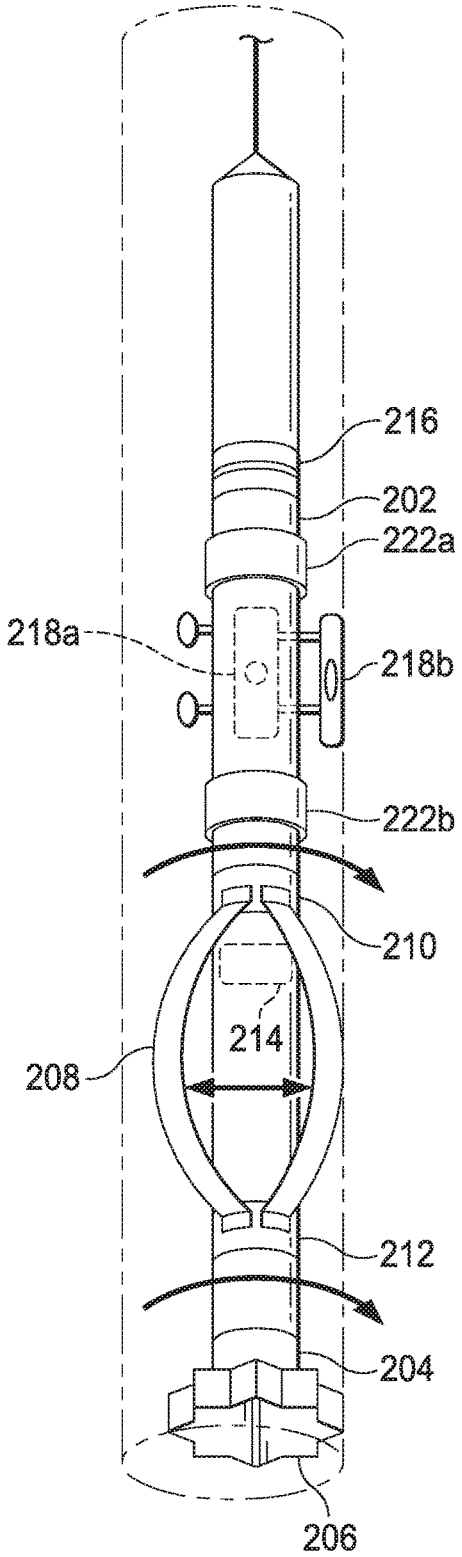
FIG. 2C is a schematic diagram of the well tool system of FIG. 1 with low friction rotating standoffs.

The well tool system 104 includes a measurement tools or a test probe 218 (for example, a formation tester, such as a probe with a packer), a stationary survey tool or a coring bit connected to the tool body 202. Once the desired radial position is established with the activation and control of radial position apparatus, the test tool is deployed for measurement or sample acquisition. After the test is completed, the probe is retracted and the tool 202 can be shifted to the next station. The schematic well tool system 104 of FIG. 2A shows the test probe 218*a* in the initial position and the adjusted alternative position 218*b*. In some implementations, the well tool system includes a backup piston (not shown) attached to the tool body 202 at a location diametrically opposite that of the test probe 218*a*. When the tool body 202 is rotated to the desired angular position, the probe 218*b* can be extended to contact the inner wall 106. In addition, the backup piston is extended in the direction diametrically opposite to the test probe 218*b* until the backup piston contacts the inner wall 106 on the opposite end. By doing so, the backup piston exerts a force on the test probe 218*a* which increases a force of contact between the test probe 218*b* and the inner wall 106. After the test probe 218*b* has performed its function, the test probe 218*b* and the backup piston can be retracted and the well tool system can either be retrieved or rotated to a new angular position. FIG. 2C is a schematic diagram of the well tool system of FIG. 1 with standoffs 222*a*, 222*b*. The standoffs are installed below the swivel and can rotate freely around the tool body 202, thereby preventing the tool sticking to the borehole wall during rotation. In some implementations, well tools such as telemetry module or gamma ray tools can be connected to the tool body 202 between the swivel 216 and the wireline.

Figure 3:
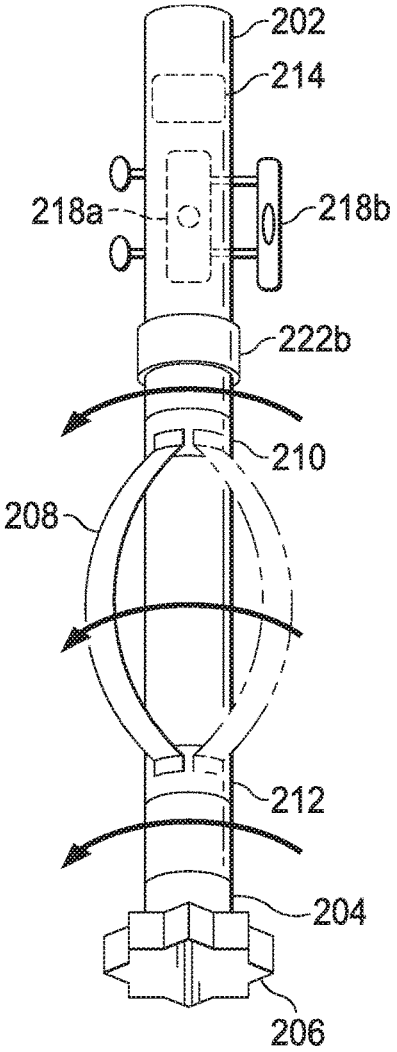
FIG. 3 is a schematic diagram of a different configuration of the well tool system of FIG. 1.

FIG. 3 is a schematic diagram of a different configuration of the well tool system 104. The different components of the well tool system 104 are arranged differently on the tool body 202 compared to the configuration shown in FIG. 2A. The configuration of the well tool system 104 in FIG. 3 is substantially similar to that shown in FIG. 2A except that the positioning sensor 214 is uphole of the decentralizing tool 208 and the test probe 218. The configuration shown in FIG. 3 can include one or more test probes similar to the test probe 218*a*, for example, between the sprocket wheel 206 and the decentralizing tool 208. The configuration in FIG. 3 demonstrates that the components of the well tool system 104 can be positioned at different axial locations on the tool body 202 as long as the sprocket wheel 206 is located either at the end of the tool body 202 or next to the decentralizing tool 208.

Figure 4A:
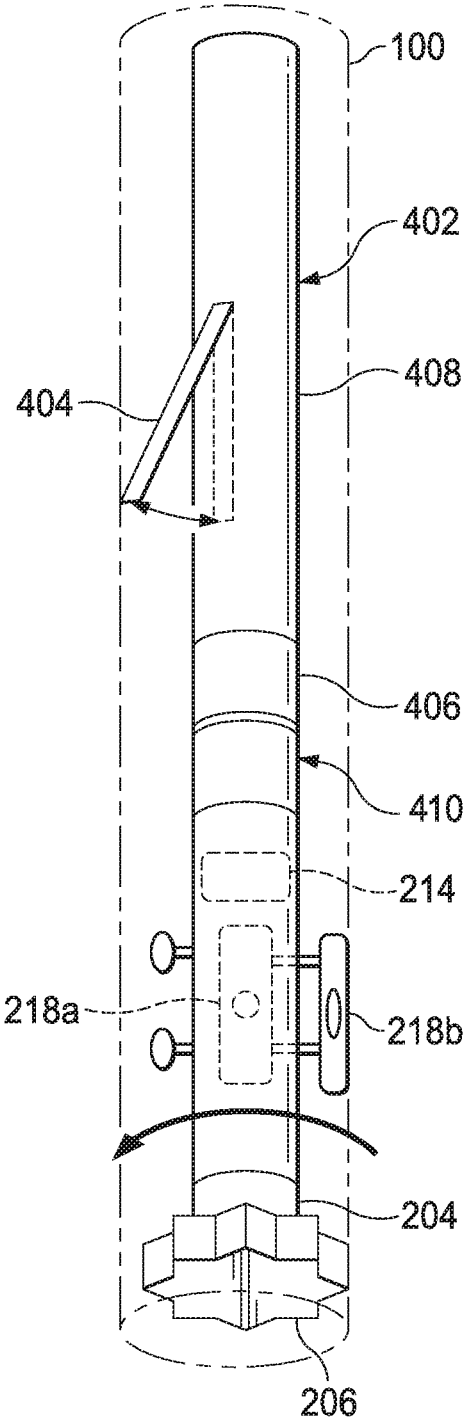
FIG. 4A is a schematic diagram of an implementation of a well tool system deployed in an open wellbore.
Figure 4B:
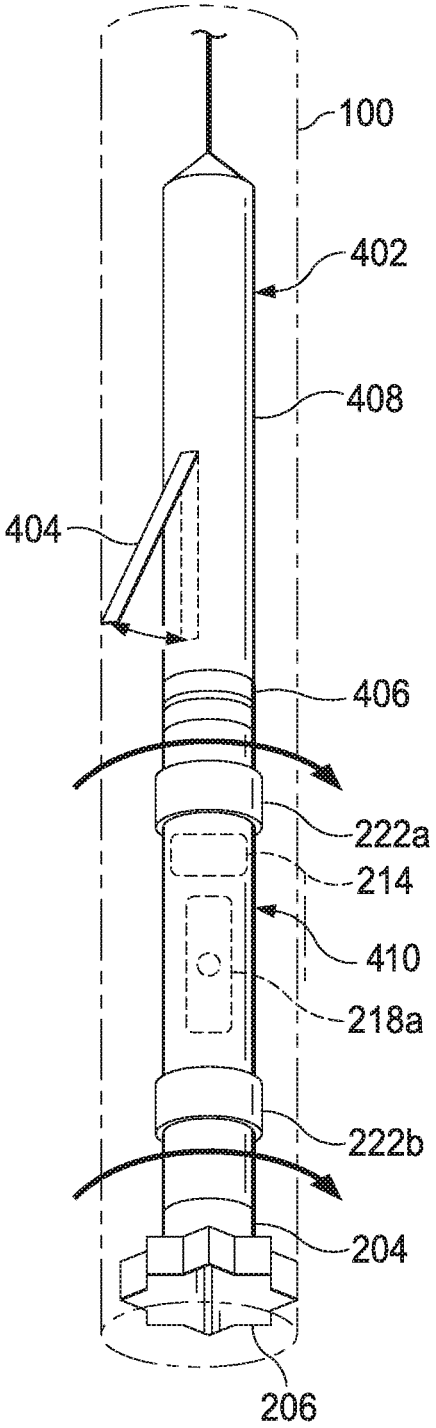
FIG. 4B is a schematic diagram of an implementation of the well tool system with low friction rotating standoffs.

Each of FIGS. 4A and 4B is a schematic diagram of an alternative tool system 402 implementation deployed without eccentralizing spring. The well tool configuration 402 consists of two parts, which are decoupled with a swivel module. The top part includes a pad, which is controlled from surface and can be activated (extended or retracted) at any desired depth. The purpose of the pad is similar to the one of eccentralizer 208. When extended, the motor 204 is activated to rotate and position a test probe, located in the lower part of the string, at a desired radial position. The swivel 406 rotationally decouples parts of the string above and below it, so the upper part of the tool remains static and at the same time the pad 404 decenters the whole string 402 to allow efficient rotation by the action of rotating mechanism.

The well tool system 402 includes a decentralizing tool 404 to perform a function similar to the decentralizing tool 208 described earlier. In some implementations, the decentralizing tool 404 can be a single-arm caliper or similar tool, which already exist in the industry. For deployment, the decentralizing tool 404 extends away from the end attached to the outer surface of the tool body 202. In this static position, the decentralizing tool 404 pushes the well tool system 402, thereby deviating the well tool system 402 away from the center of the wellbore. To return the eccentric well tool system 402 to the center, the tool 404 can be retracted toward the first portion 408. In some implementations, the extension and retraction of the tool 404 can be controlled by the controller 108. FIG. 4B is a schematic diagram of an implementation of the well tool system with standoffs 222*a*, 222*b* similar to those described with reference to FIG. 2C.

Certain components similar to those described above are mounted to the second portion 410. For example, the motor 204, the friction wheel 206, the test probe 218 and the position sensor 214 are mounted to the lower portion 410. In operation, the decentralizing tool 404 is deployed to decenter the well tool system 402 to be eccentric within the wellbore 102. The rotating wheel 206 frictionally attaches to the inner wall 106 of the wellbore. The motor 204 rigidly attached to the tool body (410) rotates the sprocket wheel. The swivel module 406 prevents the rotation of the second portion 410 from being transmitted to the first portion 408. Consequently, the first portion 408 remains rotationally stationary while the second portion 410 rotates. When the portion 410 reaches the desired radial orientation, the motor 204 ceases to rotate the second portion friction wheel (sprocket). The operations can be implemented by a direct coupling of the motor 204 and other components of the well tool system 404 or via the controller 108 as described earlier.

Figure 5A:
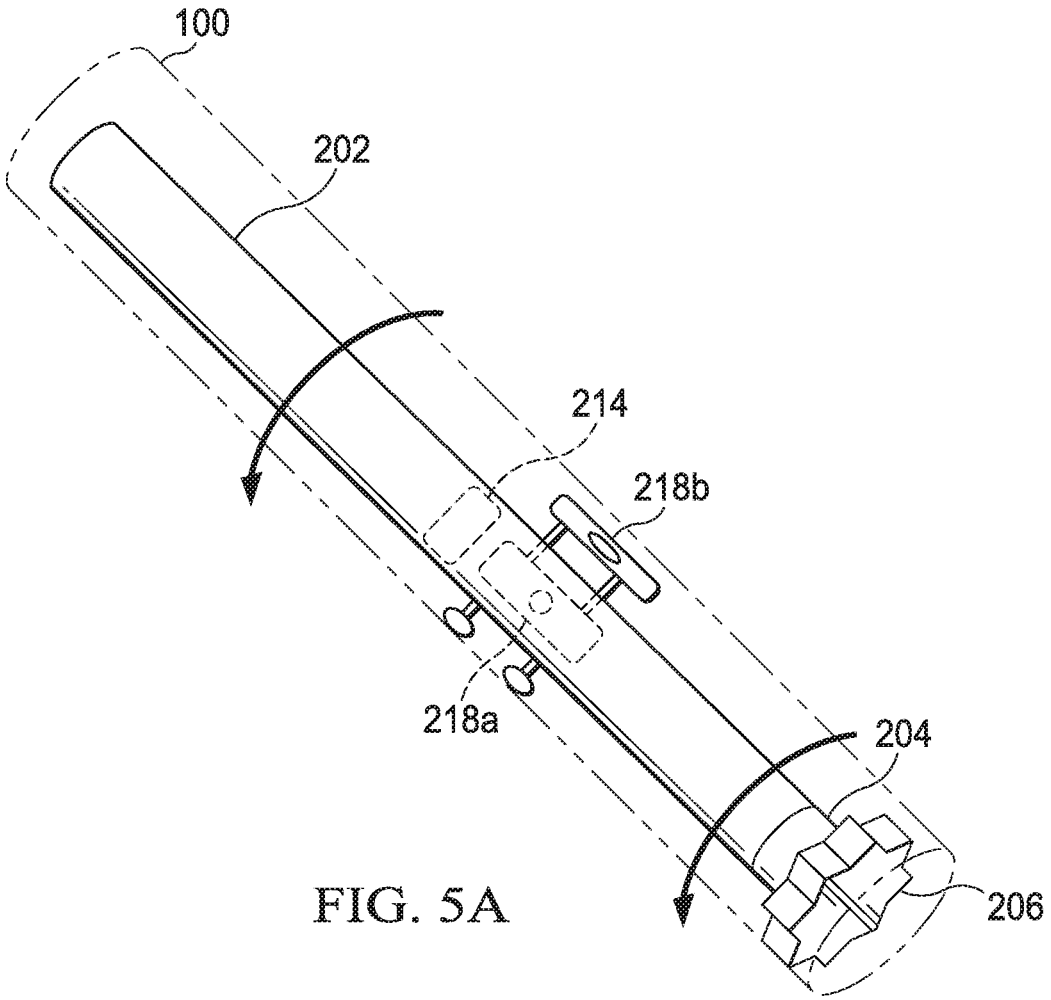
FIGS. 5A and 5B are schematic diagrams of implementations of the well tool system with standoffs.
Figure 5B:
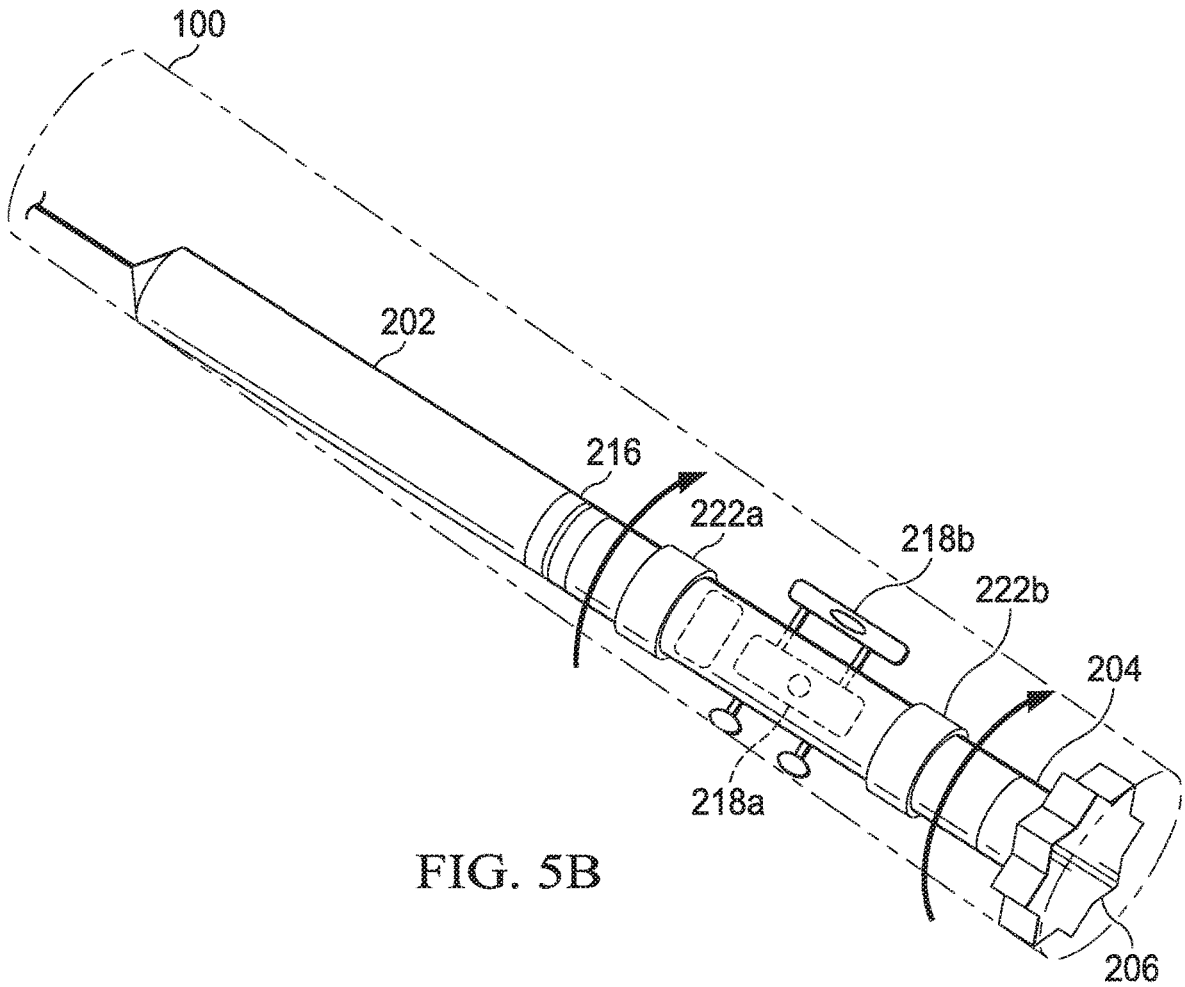

FIG. 5A is a schematic diagram of an implementation of a well tool system deployed in a deviated, open wellbore. In the implementations described earlier, the wellbore was a vertical or substantially vertical wellbore. In such a wellbore, gravity alone is insufficient to initiate and secure a firm contact between the traction tool and the inner wall of the wellbore. The well tool system 502 shown in FIG. 5A is implemented in a deviated open wellbore 500, in particular, one deviated sufficiently such that gravity alone is sufficient to initiate and secure frictional (traction) contact between the friction wheel (sprocket) 206 and the inner wall 504 of the wellbore 500. In such implementations, a decentralizing tool is generally not necessary. As shown in the schematic of FIG. 5B, the well tool system can include standoffs 222*a*, 222*b*.

Figure 6A:
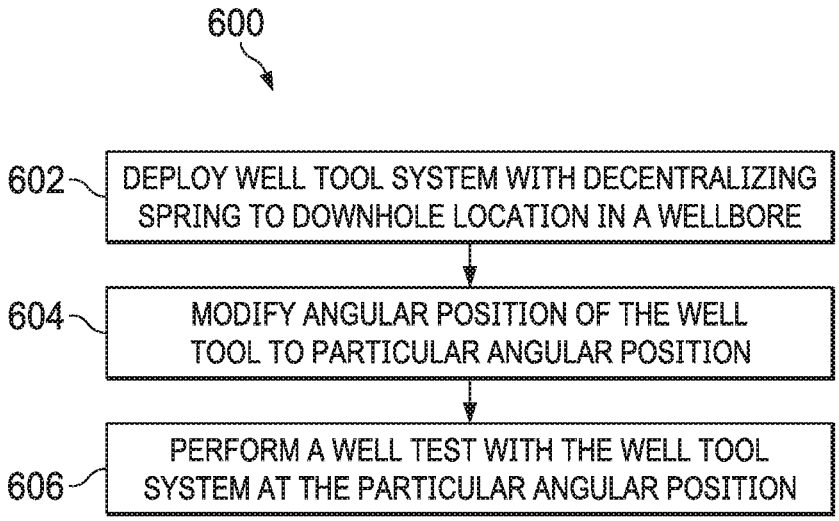
FIG. 6A is a flowchart of an example of a process for implementing the well tool system that includes a decentralizing spring.

FIG. 6A is a flowchart of an example of a process 600 for implementing the well tool system, for example, the well tool system that includes a decentralizing spring, in a vertical or substantially vertical open wellbore, for example, the wellbore 100. At 602, the well tool system is deployed to a downhole location in a wellbore using a conveyance system (wireline, slickline, coiled tubing, drill pipes etc.). The decentralizing spring eccenters the well tool system and causes the traction tool to contact the inner wall of the wellbore as the well tool system is lowered. The well tool system is lowered to a desired depth in the wellbore. At 604, the angular position of the well tool is modified to a particular angular position. Once the well tool has been lowered to the desired depth, the motor is operated to rotate the well tool from an initial angular position to the desired angular position. Because the traction tool to which the motor is connected is in traction or friction with the inner wall of the wellbore, a rotation of the motor causes the tool body to rotate as described earlier. At 606, a well test is performed with the well tool system at the particular angular position. For example, the test probe can be deployed to determine a wellbore property or obtain a sample or both.

Figure 6B:
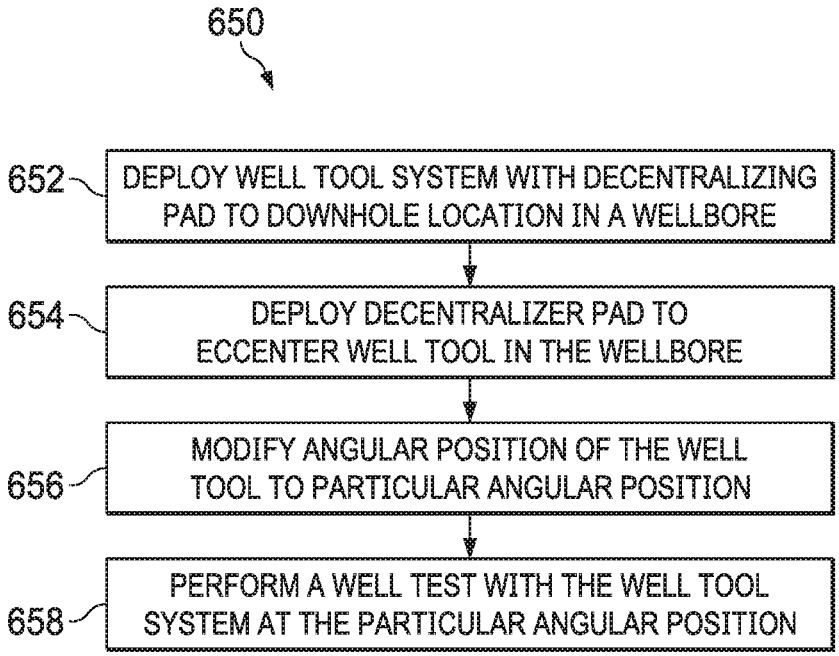
FIG. 6B is a flowchart of an example of a process for implementing the well tool system that includes a decentralizing pad tool.

FIG. 6B is a flowchart of an example of a process 650 for implementing the well tool system, for example, the well tool system that includes a decentralizing pad tool, in a vertical or substantially vertical open wellbore, for example, the wellbore 100. At 652, the well tool system is deployed to a downhole location in a wellbore using a conveyance system (wireline, slickline, coiled tubing, drill pipes, etc.). At this stage, the free-end of the decentralizing pad tool is away from the inner wall of the wellbore, for example, near an outer surface of the tool body. At 654, upon reaching the desired depth, the decentralizing pad tool is deployed to eccenter the tool in the wellbore. To do so, for example, a control signal is transmitted to the decentralizing pad tool causing the pad tool to extend from the end attached to the outer surface of the tool body. As the pad tool extends away from the tool body, the free end approaches, contacts and pushes against the inner wall of the wellbore causing the tool body to be eccentered and the traction tool to contact the inner wall of the wellbore. At 656, the angular position of the well tool is modified in a manner similar to step 604 described earlier. At 658, a well test is performed in a manner similar to step 606 described earlier.

Thus, particular implementations of the subject matter have been described. Other implementations are within the scope of the following claims.

The invention claimed is:

1. A well tool system comprising:

a tool body configured to be positioned within a wellbore;

a traction tool connected to the tool body, the traction tool configured to attach to the wellbore and comprising a friction wheel or sprocket wheel having a diameter greater than a diameter of any other part of the tool body; and a motor connected to the traction tool, the motor configured to rotate the traction tool when the traction tool is attached to the wellbore, the tool body configured to rotate relative to the traction tool in response to the motor rotating the traction tool.

2. The system of claim 1, further comprising a decentralizing tool connected to the tool body, the decentralizing tool configured to cause the tool body to be eccentric relative to a longitudinal axis of the wellbore.

3. The system of claim 2, wherein the decentralizing tool is configured to swivel relative to the tool body.

4. The system of claim 3, further comprising:

a first sleeve connected to a first end of the decentralizing tool, the first sleeve connected to the tool body, the first sleeve configured to rotate relative to the tool body; and a second sleeve connected to a second end of the decentralizing tool, the second sleeve connected to the tool body, the second sleeve configured to rotate relative to the tool body.

5. The system of claim 2, wherein the decentralizing tool comprises a decentralizing spring.

6. The system of claim 5, wherein the decentralizing spring is configured to expand to cause the traction tool to contact and attach to the wellbore.

7. The system of claim 1, further comprising a positioning sensor connected to the tool body, the positioning sensor configured to determine the angular position of the tool body in the wellbore.

8. The system of claim 7, wherein the positioning sensor is connected to the tool body, wherein the motor is configured to rotate the tool body based on the angular position of the tool body determined by the positioning sensor.

9. The system of claim 7, wherein the positioning sensor comprises at least one radial position sensor.

10. The system of claim 1, further comprising a swivel configured to couple to a wireline or a slickline to lower the well tool system into the wellbore, the tool body configured to rotate relative to the swivel.

11. A well tool system comprising:

a tool body configured to be positioned within a wellbore;

a traction tool connected to the tool body, the traction tool configured to attach to the wellbore;

a motor connected to the traction tool, the motor configured to rotate the traction tool when the traction tool is attached to the wellbore, the tool body configured to rotate relative to the traction tool in response to the motor rotating the traction tool; and a test probe connected to the tool body, the test probe configured to perform a well test within the wellbore to determine a wellbore property.

12. A well tool system comprising:

a tool body configured to be positioned within a wellbore;

a motor connected to the tool body, the motor configured to rotate the tool body within the wellbore; and a traction tool connected to the tool body, the traction tool comprising a friction wheel or sprocket wheel having a diameter greater than a diameter of any other part of the tool body and configured to attach to the wellbore, the tool body configured to rotate relative to the traction tool when the traction tool is attached to the wellbore, wherein the motor is connected to a downhole end of the tool body, and wherein the traction tool is connected to a downhole end of the motor.

13. A well tool system comprising:

a tool body configured to be positioned within a wellbore, the tool body configured to rotate within the wellbore;

a traction tool connected to the tool body, the traction tool comprising a friction wheel or sprocket wheel having a diameter greater than a diameter of any other part of the tool body and configured to attach to the wellbore, the tool body configured to rotate relative to the traction tool when the traction tool is attached to the wellbore;

a positioning sensor connected to the tool body, the positioning sensor configured to:

determine a angular position of the tool body within the wellbore, and transmit the angular position; and a motor axially connected to the tool body, the motor configured to rotate the traction tool.

14. The system of claim 13, wherein the motor is configured to cease rotation of the tool body within the wellbore in response to the angular position matching a pre-determined angular position of the tool body.

15. The system of claim 13, further comprising a decentralizing tool connected to the tool body, the decentralizing tool configured to maintain the tool body eccentric relative to a longitudinal axis of the wellbore.

16. The system of claim 15, wherein the decentralizing tool is configured to swivel relative to the tool body.

17. The system of claim 16, further comprising:

a first sleeve connected to a first end of the decentralizing tool, the first sleeve connected to the tool body, the first sleeve configured to rotate relative to the tool body; and a second sleeve connected to a second end of the decentralizing tool, the second sleeve connected to the tool body, the second sleeve configured to rotate relative to the tool body.

18. The system of claim 15, wherein the decentralizing tool comprises a decentralizing spring.

19. The system of claim 15, wherein the decentralizing tool is a pad tool attached to the tool body on one end and configured to contact an inner wall of the wellbore at another end.

20. The system of claim 15, wherein the motor is configured to rotate the traction tool after the traction tool attaches to the wellbore.

* * * * *